US008544681B2

(12) United States Patent
Bichler et al.

(10) Patent No.: US 8,544,681 B2
(45) Date of Patent: Oct. 1, 2013

(54) BAG DISPENSING MACHINE FOR UPWARD DISPENSING

(75) Inventors: Ari Bichler, Ramat Gan (IL); Doron Tam, Tel Aviv (IL); Yossi Bichler, Kfar Saba (IL)

(73) Assignee: Shekeltronix Retail Technologies Ltd., Moshav Herot, IL (US)

( * ) Notice: Subject to any disclaimer, the term of this patent is extended or adjusted under 35 U.S.C. 154(b) by 964 days.

(21) Appl. No.: 12/526,127

(22) PCT Filed: Aug. 12, 2007

(86) PCT No.: PCT/IL2007/001005

§ 371 (c)(1),
(2), (4) Date: Aug. 6, 2009

(87) PCT Pub. No.: WO2008/018083

PCT Pub. Date: Feb. 14, 2008

(65) Prior Publication Data

US 2010/0025415 A1 Feb. 4, 2010

(30) Foreign Application Priority Data

Aug. 10, 2006 (IL) ..... 177410

(51) Int. Cl.
*B65D 83/00* (2006.01)
*A47F 1/04* (2006.01)

(52) U.S. Cl.
USPC ..... 221/218; 221/1; 221/2

(58) Field of Classification Search
USPC ..... 221/33, 36, 42, 43, 56, 57, 208, 253, 221/259, 277, 279, 210, 217, 218
See application file for complete search history.

(56) References Cited

U.S. PATENT DOCUMENTS

| | | | | |
|---|---|---|---|---|
| 1,587,860 | A | 6/1926 | Rittenhouse | |
| 1,659,167 | A * | 2/1928 | Schultz | 221/98 |
| 2,659,607 | A * | 11/1953 | Skillman et al. | 273/149 R |
| 3,507,422 | A | 4/1970 | Judice | |
| 3,754,370 | A * | 8/1973 | Hanson | 53/459 |
| 3,894,732 | A * | 7/1975 | Muller | 271/10.07 |
| 4,603,847 | A * | 8/1986 | Oota et al. | 271/10.07 |
| 5,100,022 | A * | 3/1992 | Fukudome et al. | 221/198 |
| 6,006,495 | A * | 12/1999 | Varichon et al. | 53/384.1 |
| 6,029,971 | A * | 2/2000 | Lynch et al. | 271/34 |
| 6,520,375 | B2 * | 2/2003 | Youn | 221/197 |
| 2006/0008294 | A1 * | 1/2006 | Ito et al. | 399/122 |

FOREIGN PATENT DOCUMENTS

JP 6263116 9/1994

* cited by examiner

*Primary Examiner* — Gene Crawford
*Assistant Examiner* — Kelvin L Randall, Jr.
(74) *Attorney, Agent, or Firm* — Deborah Gador

(57) ABSTRACT

The present invention relates to a device for dispensing plastic bags from a stack of bags, one at a time, for use in stores and shopping areas. According to a preferred embodiment of the invention, the device includes at least one conveyor belt mounted about at least two rollers and is adapted and configured to engage a plastic bag from the stack of bags, a pressure mechanism for pressing at least one bag against the belt so as to cause the belt to engage the bag, means for rotating one of the rollers so as to cause it to drag an engaged plastic bag upwards to a dispensing area, and means for automatically stopping rotation of said belt after a single bag has been dispensed. If desired, the rate at which the bags are dispensed can also be set and controlled.

15 Claims, 6 Drawing Sheets

BAG DISPENSING MACHINE FOR UPWARD DISPENSING

FIELD OF THE INVENTION

The present invention relates to devices for dispensing bags in general and, in particular, to devices for dispensing one single plastic bag at a time in stores and shopping areas.

BACKGROUND OF THE INVENTION

Bags have been utilized for packaging store-bought goods for many years. When paper bags are utilized, they are easily separated from one another for use as needed. When plastic bags are preferred, they are packaged in flattened stacks or are sold as perforated sheets rolled about a core.

Regardless of the type or design of the bags used, the bags themselves are costly, so it is preferable to the storeowner that each customer take only as many bags as needed to carry his or her purchases. In particular, at present many customers take home a number of empty plastic bags for a variety of personal uses, in addition to those needed to wrap the customer's purchases. Furthermore, since plastic bags do not degrade, the billions and billions of plastic bags thrown away today are clogging up the land, the drains, the rivers, and the seas, and creating a severe, world-wide environmental problem. In order to solve this problem, some countries, like Ireland, have begun collecting taxes for each plastic bag taken from stores. In other areas, stores have begun charging customers for the bags they use or take away. Yet another solution is biodegradable plastic bags, although these are expensive to produce and have so far proved unsatisfactory in use.

Furthermore, since the bags are generally of plastic film, it is often difficult to open them. They usually must be crumpled or one side rubbed against the other, in order to open them. These actions take time, especially when they are required with each and every bag, thus slowing down the traffic of shoppers at the check out counters.

In order to solve the problem of customers' excessive use and consumption of plastic bags for a variety of personal uses other than just for carrying their purchases, a dispensing machine which dispenses automatically one bag at a time was disclosed in patent application No. PCT/IL03/01114 which is assigned to the assignee of the present application and which is incorporated by reference herein. This machine is located adjacent the cash register and includes a plate having a frame, a rotatable shaft coupled to the frame, at least one roller non-rotatably affixed to the shaft and arranged to engage a bag of the stack of bags, means for rotating the shaft, and means for automatically stopping rotation of the shaft after a single bag has been dispensed, wherein the stack of bags is held against one side of the plate, and the single bag is dispensed to an opposite side of the plate. After the bag is detached from the stack of bags, it falls within the housing to a dispensing area. Although this machine addresses the problem of customers taking more bags than they need for carrying the purchases, still it does not try to solve the problem of opening the bag for fast packaging of the purchased products. It also requires that the device be disposed on a counter past the cashier, taking up space which would otherwise be available for purchases.

Accordingly, there is a long felt need for a bag dispensing device which dispenses only one bag at a time and includes a control unit for controlling the number and rate of bags dispensed and, it would be very desirable to have such a device wherein the dispensed bags are easily opened and ready for use by the customers, which device preferably could be disposed under the counter during use.

SUMMARY OF THE INVENTION

The present invention provides a bag dispensing device which dispenses a single bag at a time, and which includes a control mechanism to prevent removal of a further bag before the previous bag has been taken from the device. In this way, the number of bags taken can be monitored and controlled.

There is thus provided, is accordance with the present invention, a device for dispensing a bag from a stack of bags, the device including at least one conveyor belt mounted about at least two rollers and adapted and configured to engage a plastic bag from the stack of bags, a pressure mechanism for pressing at least one bag against the belt so as to cause the belt to engage the bag, means for rotating one of the rollers so as to cause it to drag an engaged plastic bag upwards to a dispensing area, means for automatically stopping rotation of the belt after a single bag has been dispensed.

According to one embodiment of the invention, the device further includes a second conveyor belt mounted with a portion adjacent to a portion of the first conveyor belt and arranged for movement in an opposite direction thereto, the first and second conveyor belts being adapted and configured for frictionally conveying a plastic bag upwards therebetween.

According to another embodiment, the device further includes a bag retarder mounted beneath and adjacent a lower of the rollers for stopping from moving downwards a bag that has been detached from the stack of bags and causing it to be engaged between adjacent portions of conveyor belts.

According to another embodiment of the invention, there is provided a device for dispensing a bag from a stack of bags, the device including a first and second conveyor belt adapted and configured to engage a plastic bag from the stack of bags, the first conveyor belt being mounted about three rollers, the second conveyor belt being mounted about two rollers, two arms merging into pressure bars for pressing at least one bag against the first conveyor belt so as to cause the belt to engage the bag, means for rotating the first and second conveyor belts so as to cause them to drag an engaged plastic bag upwards between them to a dispensing area, and means for automatically stopping rotation of the belt after a single bag has been dispensed.

There is also provided in accordance with the present invention a method for dispensing a bag from a stack of bags, the method including mounting at least one conveyor belt about at least two rollers, the belt adapted and configured to engage a plastic bag from the stack of bags, pressing at least one bag against the belt so as to cause the belt to engage the bag and to cause a wall of the bag to be separated from one another, rotating one of the rollers so as to detach the bag from the stack and to cause the conveyor belt to drag an engaged plastic bag upwards to a dispensing area, and automatically stopping rotation of the belt after a single bag has been dispensed.

BRIEF DESCRIPTION OF THE DRAWINGS

The present invention will be further understood and appreciated from the following detailed description taken in conjunction with the drawings in which.

DETAILED DESCRIPTION OF THE INVENTION

The present invention relates to a device for dispensing plastic bags, one at a time, for use in stores and shopping areas. The device dispenses a single bag at a time and can be coupled to a cash register or other controller for control of the total number of bags dispensed to each customer. If desired, the rate at which the bags are dispensed can also be set and controlled.

Figure 1:
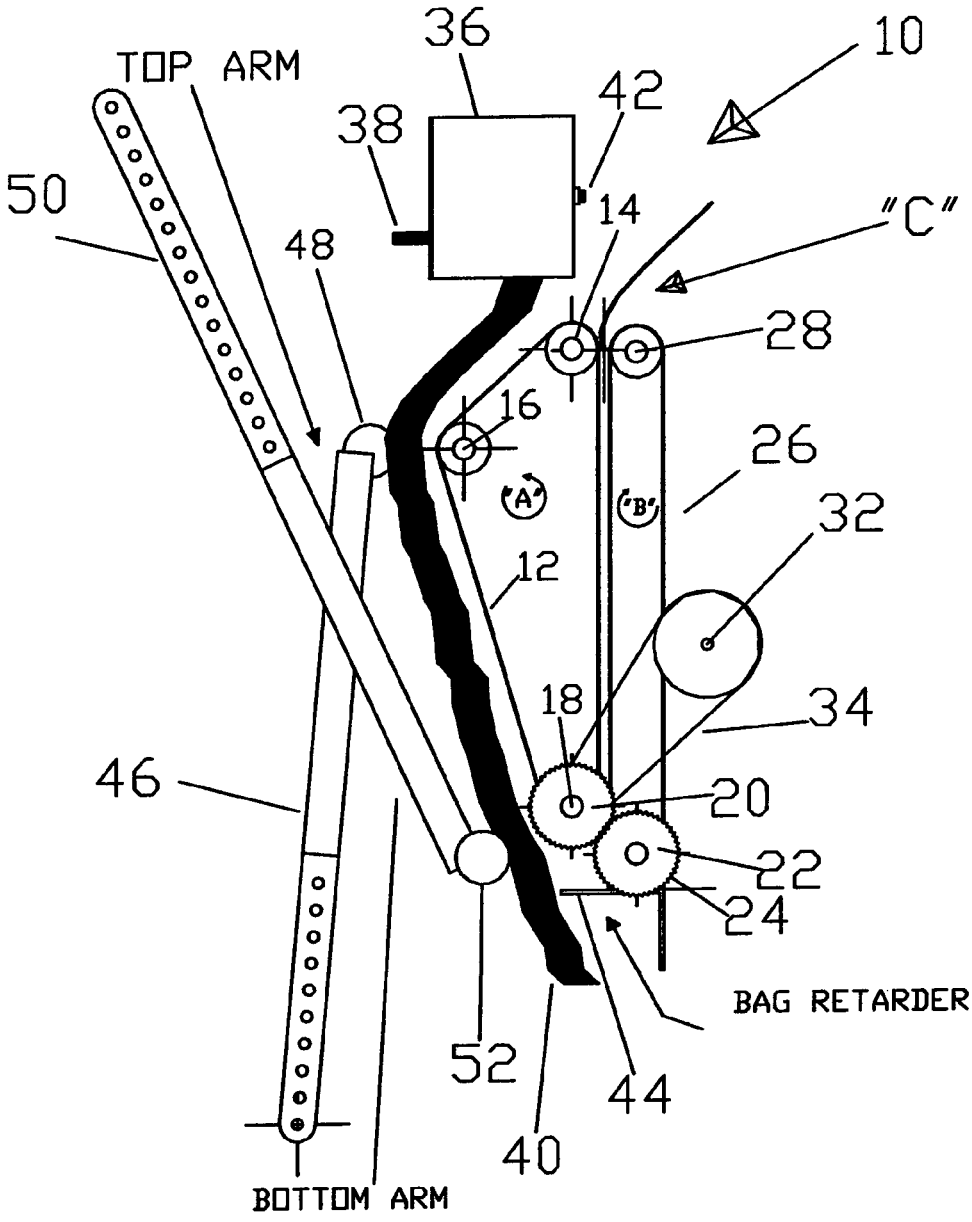
FIG. 1 is a schematic side view illustration of a device for dispensing bags constructed and operative in accordance with a preferred embodiment of the present invention.
Figure 2:
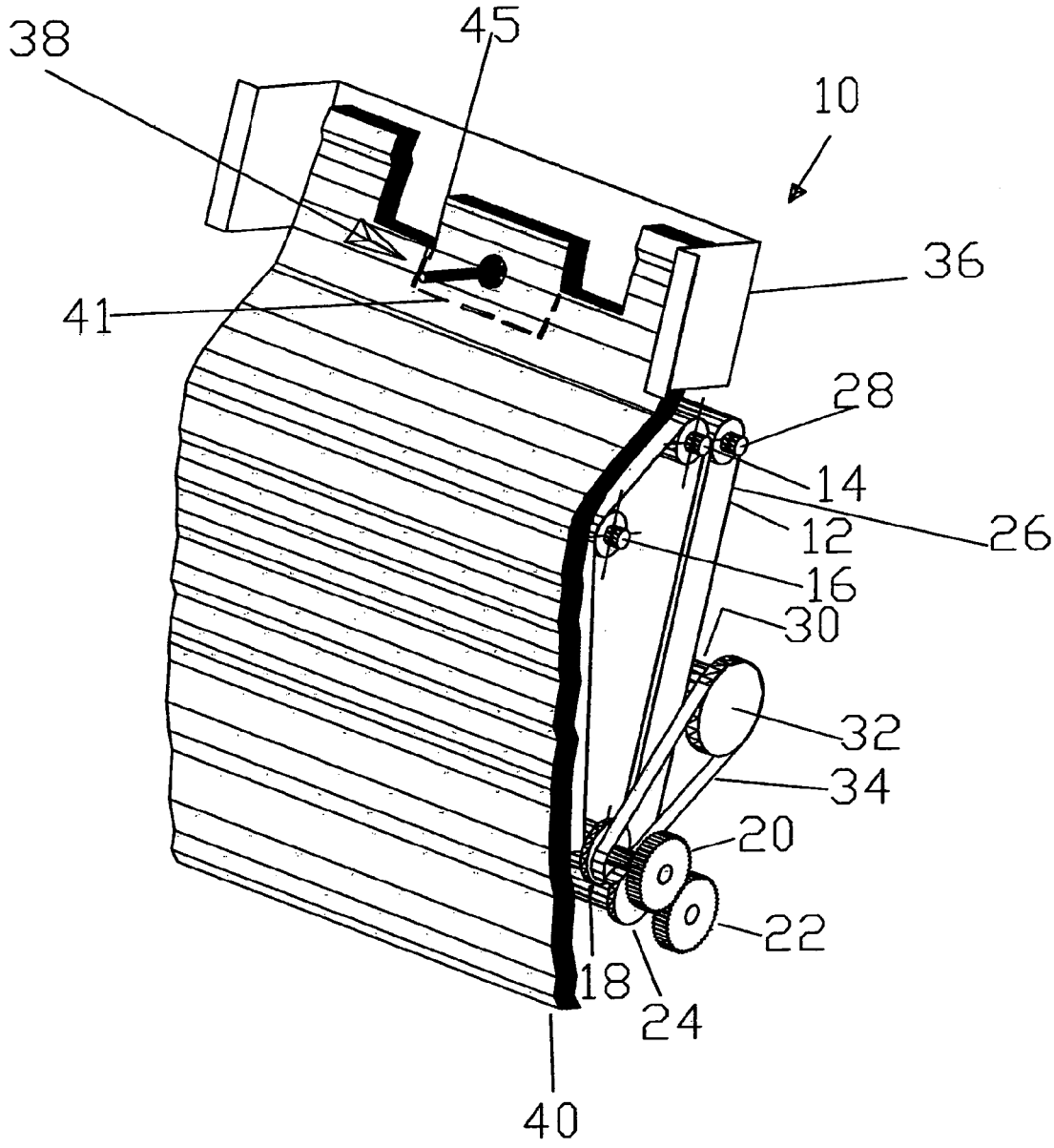
FIG. 2 is a schematic perspective rear view of the device of FIG. 1, ready for operation, with a stack of bags in place.
Figure 3:
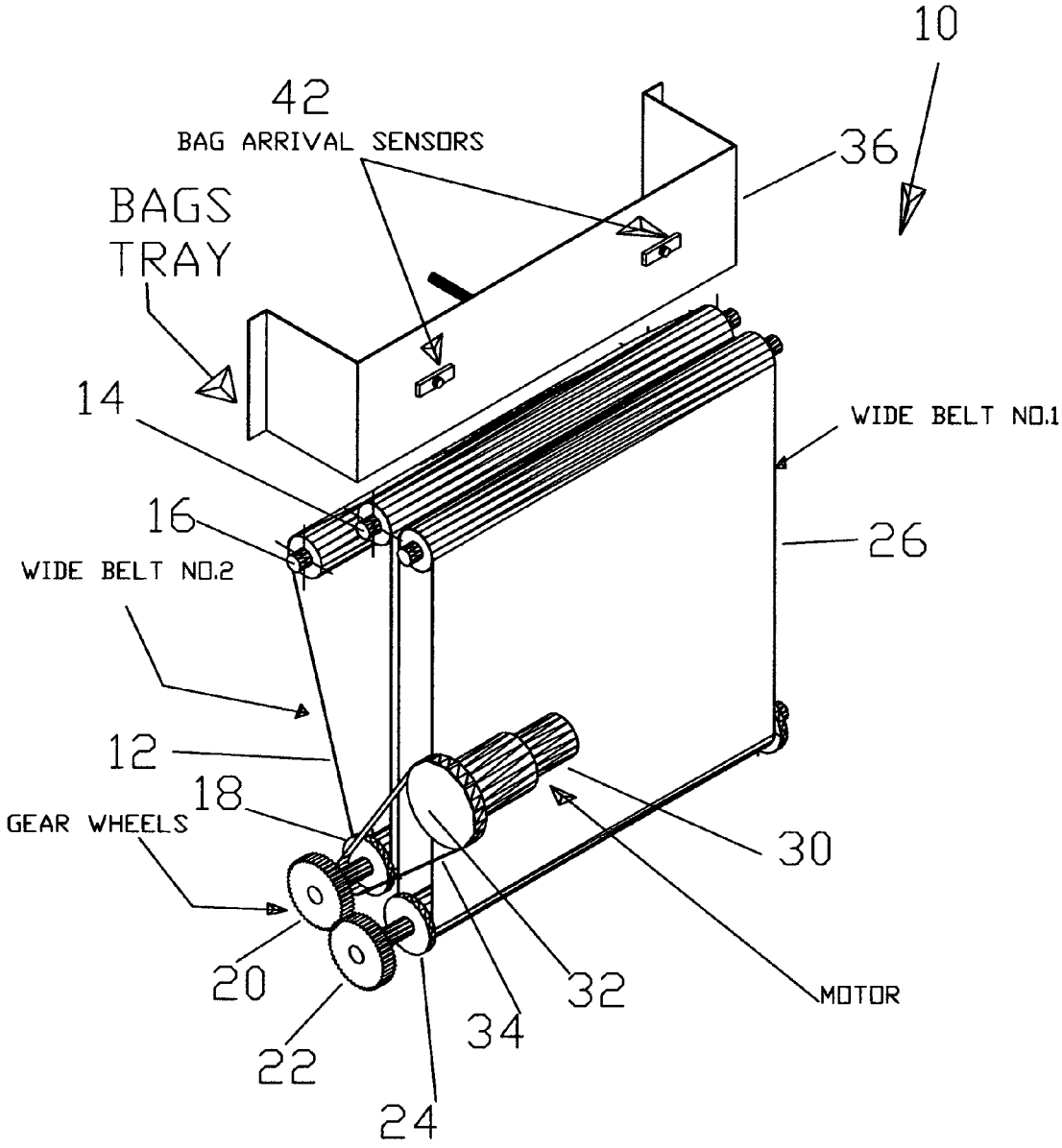
FIG. 3 is a schematic perspective front view illustration of the device of FIG. 1.

Referring now to FIGS. 1, 2, 3 and 4, there are shown schematic side and rear view illustrations of a device 10 for dispensing bags, constructed and operative in accordance with one embodiment of the present invention. Bag dispensing device 10 includes a first conveyer belt 12 mounted about three rollers 14, 16 and 18. A first gear wheel 20 is fixedly mounted on roller 18 and serves to rotate a second gear wheel 22 which, in turn, is fixedly mounted on a roller 24. A second conveyor belt 26 is mounted about two rollers, roller 24 and roller 28. As illustrated in FIG. 3, a motor 30 having a pulley 32 rotates a driving roller 18 via a driving belt 34. Gear wheel 20 rotates gear wheel 22 which, in turn, rotates roller 24. The rotation of driving roller 18 causes conveyor belt 12 to move around rollers 14, 16 and 18 in the direction marked by arrow "A", and the rotation of roller 24 causes conveyor belt 26 to move around rollers 24 and 28 in the opposite direction marked by arrow "B".

According to an alternative embodiment, the means for rotating roller 18 can be a handle (not shown) or any other manual means of causing rotation of roller 18.

The device according to the present invention further includes a bag support 36 having a holding pin 38 for holding a stack of bags 40. In the embodiment illustrated in FIG. 2, the bags are conventional plastic bags and have a stub 45, near the center of the top end of the bags, with a hole. Holding pin 38 is threaded through the holes of all the bags in stack 40 in order to retain the tops of the bags against the pull of the belt 12. Preferably, the stack of bags 40 is held against bag support 36 such that the bottoms of the bags extend above belt 12, as seen most clearly in FIG. 2.

Holding pin 38 also serves to oppose belt 12, so as to prevent all the bags in the stack from being dispensed together. It will be appreciated that, while the invention has been illustrated utilizing plastic bags having two handles, by way of example only, the device for dispensing bags can be utilized with any type or design of bags, including paper bags, or plastic bags of any design. It will further be appreciated that, depending upon the design of the bags, the stack of bags can be held with the tops of the bags (the openable portion) upside down, rather than in the illustrated direction.

As further illustrated in FIG. 2, each bag of stack 40 is perforated at a perforation line 41 for easing the detachment of the bag from the support by the friction force applied to the bag by conveyor belt 12. At least one detector 42, such as a photoelectric eye, is mounted on the front surface of bag support 36, in order to detect the presence of a dispensed bag in a dispensing area C. Alternatively, detector 42 can be any other detection means, such as a capacitative sensor or such, for detecting a dispensed bag adjacent the detector.

Figure 4:
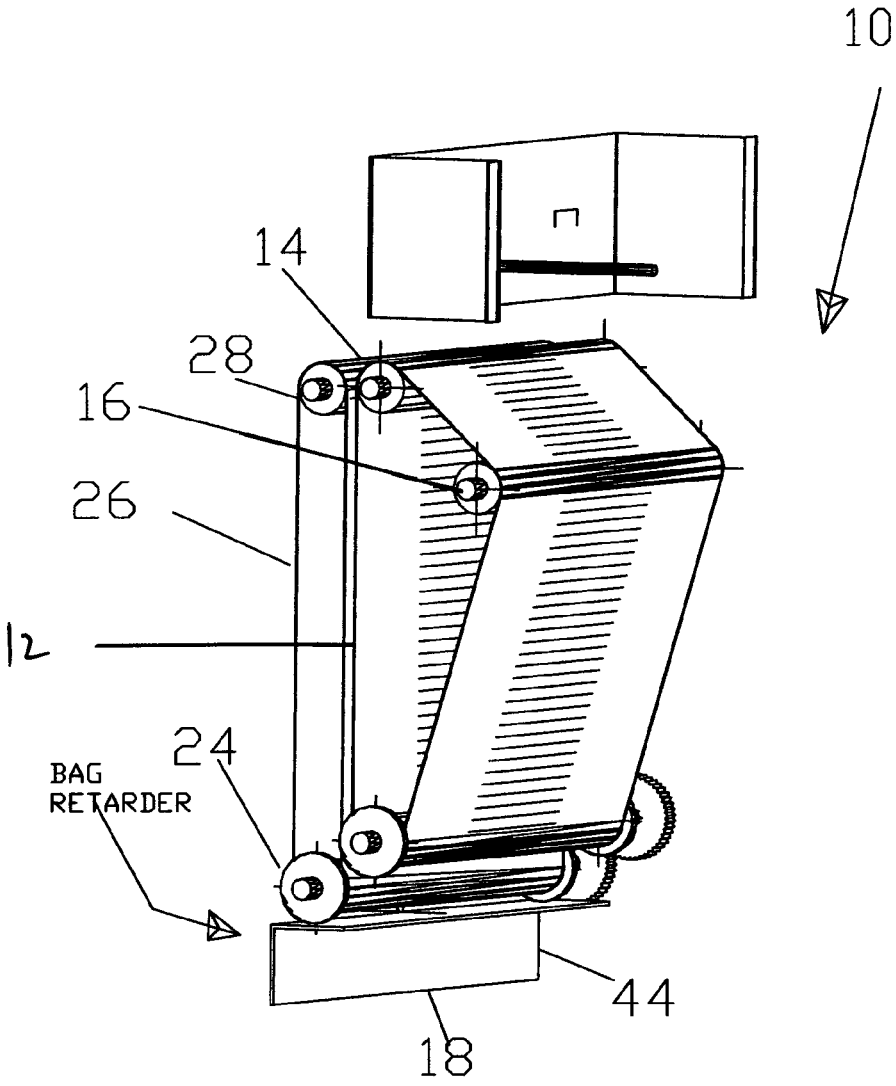
FIG. 4 is a schematic perspective side view from the rear of the device of FIG. 3.

As shown in FIG. 4, a bag retarder 44 is mounted beneath and adjacent to roller 24 to stop the bag 43, that has been detached from the stack of bags 40, from moving downwards and cause it to be engaged between adjacent portions of conveyor belts 12 and 26. The detached bag is then pulled up by the frictional force created between the outside walls of bag 43 and each of the adjacent conveyor belts, to the dispensing area C. Stack of bags 40 is pressed against conveyor belt 12 by a pressure mechanism. In FIG. 1, the pressure mechanism is illustrated as a first arm 46 having a substantially horizontal pressure bar 48 coupled to its end for applying pressure across stack 40 in registration with roller 16, and second arm 50 having a substantially horizontal pressure bar 52 coupled to its end for applying pressure across stack 40 in registration with roller 18. Bars 48 and 52 are preferably substantially cylindrical, as shown in FIGS. 1 and 4. This shape provides consistent pressure on the stack of bags at any angle of arms 46 and 50 relative to the stack.

The device according to the present invention may also include a frame or a housing (not shown) for supporting the device by coupling its parts thereto. It will be appreciated by a person skilled in the art that rollers 14, 16, 18, 24 and 28 and bag support 36 can be mounted on a housing having at least two substantially parallel walls, wherein one wall supports one end of the rollers and the bag support and the opposite wall supports the second end of the rollers and the bag support. Arm 46 and arm 50 and motor 30 can be mounted on any of these two walls or on the other walls of the housing, as is convenient and effective for the device to perform according to the present invention.

Figure 5:
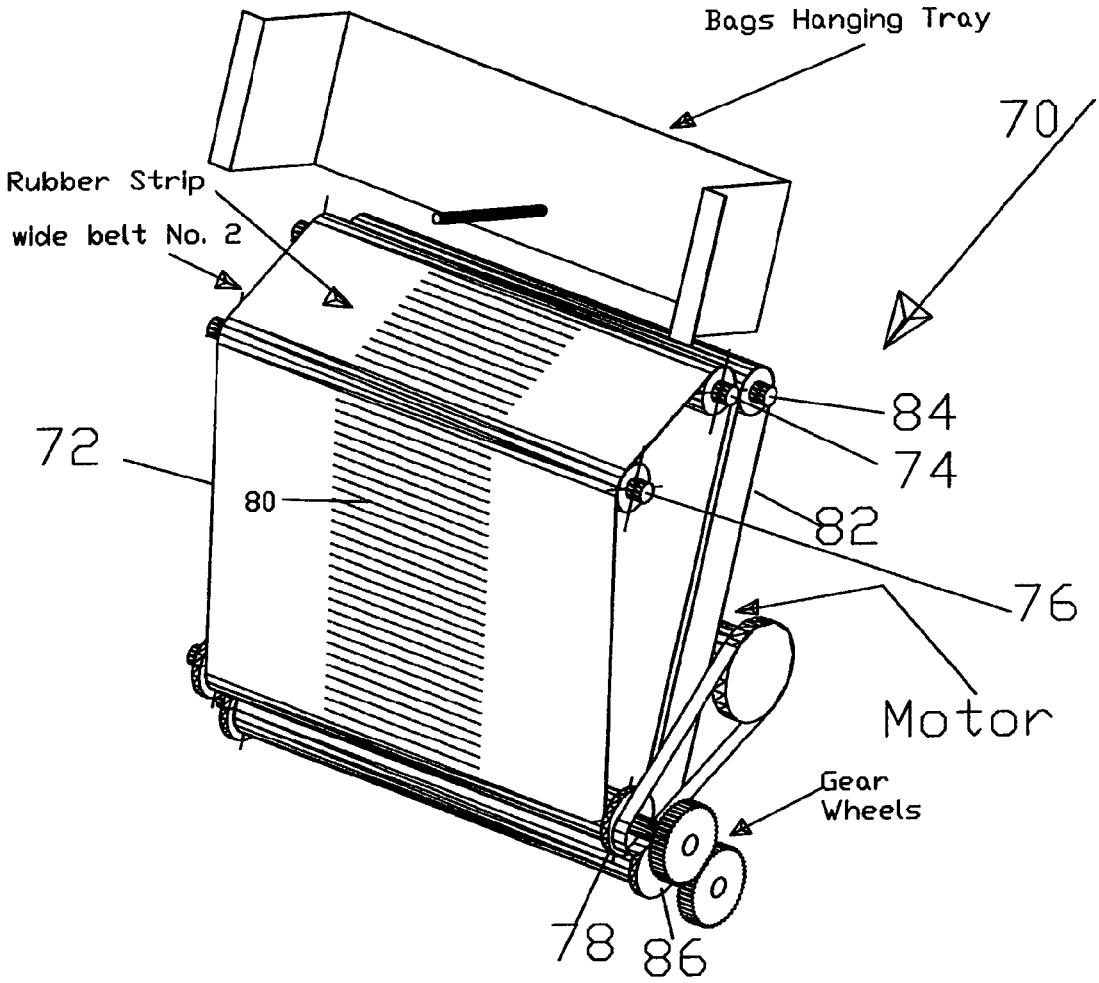
FIG. 5 is a perspective side view from the rear of a device for dispensing bags constructed and operative in accordance with another embodiment of the present invention.

Now referring to FIG. 5, there is shown a front view of a device 70 according to another embodiment of the invention. A conveyor belt 72 is mounted around rollers 74, 76 and 78. Belt 72 preferably includes a rough surface 80, substantially along the center of the belt, for increasing the friction with the bag in a stack of bags hanging from a bag support, which is pressed against conveyor belt 72. In the embodiment illustrated in FIG. 5, rough surface 80 covers the center portion of belt 72. Thus, it provides for asymmetrical downward motion of the bag, i.e., the wall of the bag engaged by the conveyer belt separates somewhat from the other wall of the bag, and the portion of the bag pressed against a rough portion of the belt will move somewhat further or slightly faster than the other portions of the bag. This causes distortion of the walls of the bag and causes partial separation of the walls of the bag from one another, so that a user can open the dispensed bag more easily. It will be further appreciated that according to alternative embodiments of the present invention, the rough portion or portions of the belt can be placed on different parts of the belt. According to further embodiments, a separate layer of rough material may be affixed to a substantially smooth belt in desired locations, to produce the same result.

According to the embodiment shown in FIG. 5, conveyor belt 72 is a wide belt substantially covering the entire length of rollers 74, 76 and 78. As is further shown, conveyor belt 82 is also a wide belt, substantially covering the entire length of rollers 84 and 86. It will be appreciated that according to alternative embodiments of the present invention, belts 72 and 82 or any of them may be replaced by one or more narrow belts, and need not substantially cover the entire length of the rollers.

As further shown in FIGS. 1-4, rollers 14 and 18 are axially displaced while roller 16 is disposed between these two rollers and preferably distanced from them and from the adjacent portions of conveyer belts 12 and 26. This positioning of roller 16 causes bending of stack of bags 40 around roller 16, thus increasing the friction between a bag in the stack which is adjacent belt 12 and the rough part of belt 12 and assuring partial separation of the walls of the bag from one another prior the bag is completely detached from the stack of bags 40 at perforation line 41. The location of roller 16 in register with a pressure bar 48 (as shown in FIG. 1) further strengthens the frictional connection between the bags and the belt.

As stated above, roller 24 is disposed adjacent gearwheel 20 so that gearwheel 22 mounted on roller 24 engages gearwheel 20. Preferably, roller 28 is disposed adjacent roller 14 so that detached bags can be dispensed at the desired location. This arrangement of the rollers permits conveyor belts 12 and 26 to move adjacent each other through part of their paths. After being detached from the stack of bags, the detached bag is engaged between the adjacent portions of the conveyor belts, which lift the bag by the frictional force created between each of the belts and the adjacent walls of the bag, all the way up to the dispensing area "C", as shown in FIG. 1, where it can be removed by the user.

According to one embodiment, one of the gearwheels 20, 22 is substantially larger than the other, creating relatively fast motion of one belt relative to the other. This would result in sufficient elevating force to lift a bag between the two belts and cause separation between its front and back walls, even without a rough area on one of the belts.

According to an alternative embodiment of the invention, conveyor belt 12 is mounted about only two rollers, without the need for an additional roller 16.

As illustrated in FIGS. 1 and 4, arms 46 and 50 apply pressure to the stack of bags 40. Bar 48 serves to press the bags in the stack against conveyor belt 12, against counter pressure by roller 16. Similarly, bar 52 serves to press the bags in the stack against conveyor belt 12 against counter pressure by roller 18. In this way, the stack is held firmly between bar and roller, while the bag adjacent the conveyor belt 12 is being dragged by the belt. Pressure bar 48 and pressure bar 52 apply pressure on stack 40 against belt 12 concurrently. The frame or housing (not shown) of the device are adapted and configured to apply pressure on arms 46 and 50, which is transferred to pressure bars 48 and 52, respectively. Such pressure on arms 46 and 50 may be created by spring biasing the arms against the frame or housing or alternatively pivotally mounting the arms on a closing door of the housing, which may be opened to mount stack 40 on bag support 36 and, when closed, applies pressure to the arms resting against the stack. The rotation of roller 18 pulls on the bag adjacent belt 12, thus increasing the frictional force between the bag and the belt adjacent roller 16 until the bag is detached from stack 40 at the perforation line 41 and moves along belt 12 until it abuts bag retarder 44. Arm 46 is adapted and configured to provide pressure applied by bar 48 on stack 40 which is sufficient only for horizontal distortion of the bag adjacent belt 12, as described below.

Figure 6:
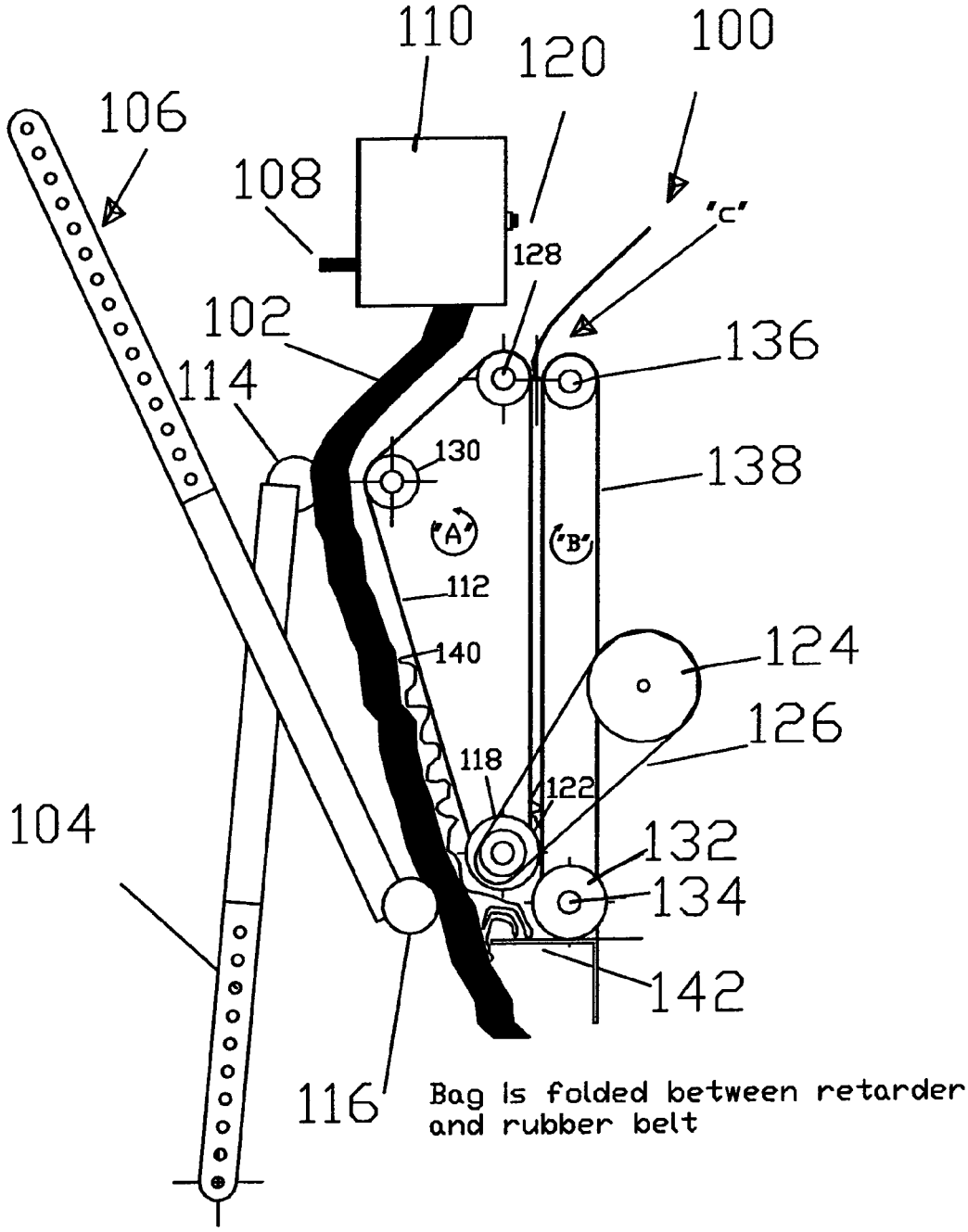
FIG. 6 is a schematic side view of a device for dispensing bags constructed and operative in accordance with the present invention in operation.

Operation of the device of the present invention will now be described with reference to the embodiment of FIG. 6, by way of example only. First, a stack of bags 102 to be dispensed is mounted in device 100. This can be accomplished by distancing arms 104 and 106 away from conveyor belt 112, mounting the stack on holding pin 108 in bag supporter 110, and placing the stack on the conveyor belt, as seen in FIG. 6. Secondly, arms 104 and 106 are pressed towards conveyor belt 112, as by closing a door of the housing, thereby applying pressure to bars 114 and 116 which, in turn, apply pressure to stack 102. In this embodiment, the bags in stack 102 are held upright, with their lower portion engaged by a bar 116, mounted in register with a roller 118, which press the lower portion of the bags against belt 112.

When detector 120 detects the absence of a dispensed bag, it actuates a motor (shown in FIG. 3). The motor drives gearwheel 122 via pulley 124 and driving belt 126, causing rotation of roller 118 which moves belt 112 around rollers 118, 128 and 130, in the direction of arrow A. Rotation of gearwheel 122 rotates, in turn, gearwheel 132 frictionally engaged therewith, causing rotation of rollers 134 and 136, which moves belt 138 around rollers 134 and 136, in the direction of arrow B. Movement of belt 112 applies asymmetric frictional force to bag 140 of stack 102, particularly adjacent rollers 118 and 130, which partially separates the bag from the stack, pulls it in the direction of a bag retarder 142 and causes partial separation of the walls of the bag from one another. When the frictional force applied to bag 140 becomes greater than the strength of the bag at perforated line 144, bag 140 is detached from stack 102 and is dragged by belt 112 until its bottom edge abuts bag retarder 142. Continued motion of belt 112 causes bag 140 to fold between the retarder and belt until its walls are frictionally engaged between belt 112 and belt 138, which move in the direction of arrows "A" and "B", respectively. Such engagement causes bag 140 to move between the adjacent portions of the belts in the direction of the arrows until it reaches a dispensing area "C" beyond rollers 128 and 136, where bag 140 is detected by detector 120. When detector 120 detects the presence of a bag, it stops the motor, which stops the motion of bag 140 until it is removed by a customer. At this time, detector 120 detects the absence of a bag and actuates the motor, which causes the belts to convey and dispense another bag.

According to a preferred embodiment of the invention, the device is arranged to always have one dispensed bag available for removal by a customer.

It will be appreciated that the pressure applied by pressure bars 114 and 116 to the stack is transferred to the bag engaged by the conveyor belt 112. The first bag in the stack is dragged by the friction force of the belt applied by both pressure bars 114 and 116 and is detached from the holding pin. It is now conveyed downwards by the belt towards the bag retarder, and the upper bar 114 and roller 130 engage and begin to stretch the next bag in the stack. However, the pressure applied by upper bar 114 and roller 130 alone is not sufficient to detach the second bag from the holding pin. Only when the first bag has been released by the lower bar 116 and has cleared the lower roller 118 onto the bag retarder, do both bars apply pressure to the second bag, and detach it from the pin. It is a particular feature of the invention that, once a bag has reached the dispensing area, rotation of the roller 118, and consequently motion of the belts 112 and 138, is stopped. This can be accomplished in a variety of ways, e.g., by electronically stopping rotation of the motor, or by mechanically stopping rotation of the roller and simultaneously electronically stopping the rotation of the motor, or stopping the transfer of power to the roller from the motor, as by means of a clutch (not shown), or in any other fashion. In the embodiment of FIG. 6, when the detector 120 detects the presence of a bag, the detector causes operation of the motor to stop, as by electronic relays (not shown), so that only a single bag is dispensed at a time.

The dispensed bag is held between the belts as seen in FIG. 6, and is available for use at any time. It is a particular feature of the invention that a user removing a dispensed bag is unable to reach or remove additional bags from the stack. Rather, he must remove the dispensed bag, and wait while the detector actuates the motor to dispense another bag, in order to take a second bag. According to yet another feature of the present invention, the user is unable to remove a bag during the dispensing process, but only after it has reached the dispensing point at the end of the process.

A number of indicators (not shown) may be provided on the housing (not shown) of the device according to the present invention. One indicator can indicate when the device is on standby, i.e., coupled to a power source and waiting with a dispensed bag. Another indicator can be used to indicate that all bags in the device have been dispensed, or when only a pre-selected small number of bags remain, so as to permit prompt replacement of a full stack of bags. Needless to say, the housing can be opened or removed in order to insert a new stack of bags, or for other maintenance.

According to one embodiment of the invention, the device can be coupled to a cash register in the store, so as to control the number of bags dispensed per customer and to charge the customer for the bags used, if desired. In this case, the device further includes a controller (not shown) to control and monitor the device, and for communication with the cash register or central store computer. The controller may comprise a CPU and a memory unit or a complete processor, as known in the art. Thus, an electronic connection of any technique can be provided coupling the register with the controller, so as to permit communication between the two. Thus, a wired or wireless connection can be provided for control and/or monitoring of the bag dispensing device by the cash register or central computer of the store via the register. Consequently, the controller can be used to permit the cashier to cause the device to dispense a desired number of bags, i.e., a number paid for in advance by the customer, or to which he is entitled, due to the quantity and size of his or her purchases. In addition, the controller can be used to collect data, e.g. count the number of bags used and/or remaining in the stack, for purposes of stock control, budgeting, accounting, and the like.

According to a further embodiment of the invention, the controller can be programmed to determine the number of bags required by each customer, depending upon the goods he or she has purchased. Such a program could determine the required number of bags by providing the controller with data of, for instance, the categories of goods (heavy, large, small, food or cleaning supplies, etc.) and the number of units per each category. Alternatively, the register could include such a program for automatically determining the number of required bags, and cause the device to dispense that number. An option can be provided for the cashier to indicate if the customer is elderly or has a physical limitation requiring lighter than normal packing (i.e., requiring a larger number of bags.)

According to another embodiment, the housing (not shown) may include a display (not shown) which can be used to provide informative messages to shoppers or for advertising purposes. According to one embodiment, the display is a conventional frame, pocket, or light box, into which a suitable advertising poster or removable advertising materials can be inserted. Alternatively, the display can be an electronic display having a controller for periodically changing the advertisement displayed thereon. If the device includes a controller, the same controller can be used also to control the electronic display. According to one embodiment, the display is coupled to the main computer of the store in which it is used, so the content displayed thereon can be monitored and controlled by responsible parties in the store.

According to another embodiment, a sensor (not shown) can be provided on arm 104 or arm 106 (FIG. 6) or in any other location on the device, to determine the quantity of bags remaining in the stack. Once the quantity of bags falls below the pre-set threshold, an audible signal may be provided, and/or an indicator will light up, to indicate to an operator that a new stack of bags will be required shortly.

It will be appreciated that means other than a motor can be utilized to cause rotation of roller 118. According to one alternative embodiment of the invention (not shown) the means for rotating roller 118 can be a handle or any other manual means that can cause rotation.

It will be appreciated that the rollers in the bag dispensing device which are not coupled to the gearwheels can be revolving or stationary.

According to another embodiment of the invention, the detaching and dispensing mechanism may include only a single belt 12'. In such an embodiment, the stack of bags will be mounted on a support on the bottom of the device, belt 12' will rotate in the opposite direction, such that the individual bags will be detached by an upward motion of the belt.

While the invention has been described with respect to a limited number of embodiments, it will be appreciated that many variations, modifications and other applications of the invention may be made. It will further be appreciated that the invention is not limited to what has been described hereinabove merely by way of example. Rather, the invention is limited solely by the claims which follow.

The invention claimed is:

1. A device for dispensing a bag from a stack of bags, the device comprising:

a bag support, the stack of bags hanging from the bag support;

a first and a second conveyor belt, each said conveyor belt mounted about at least two rollers;

said second conveyor belt mounted with a portion adjacent to a portion of the first conveyor belt and arranged for movement in an opposite direction thereto, said first and second conveyor belts being adapted and configured for frictionally conveying a plastic bag upwards therebetween;

a pressure mechanism for pressing the hanging stack of bags against said first conveyor belt so as to cause said first conveyor belt to engage a bag from the stack of bags, and detach said engaged bag from the support;

a bag retarder mounted adjacent and beneath said first and second conveyor belts for stopping said detached bag, which folds between said retarder and said belts until said bag is engaged between said first and said second conveyor belts, which drag said detached bag upwards to a dispensing area;

means for rotating one of said at least two rollers of each said conveyor belt so as to cause said first and second conveyor belts to move around said rollers; and means for automatically stopping rotation of said first and second conveyor belts after a single bag has reached said dispensing area.

2. The device according to claim 1, further comprising a third roller about which said first conveyor belt is mounted.

3. The device according to claim 1, further comprising at least one pressure bar mounted in registration with one of said rollers of said first conveyor belt.

4. The device according to claim 1, further comprising a rough portion on said first conveyor belt.

5. The device according to claim 4, wherein said rough portion includes a separate layer of rough material affixed to a substantially smooth belt.

6. The device according to claim 1, wherein said means for automatically stopping includes a dispensed bag detector adapted to stop rotation of said belts in response to detection of a dispensed bag in said dispensing area.

7. The device according to claim 1, further comprising a housing in which the device is mounted, said housing including an opening adjacent said dispensing area to permit removal of a dispensed bag.

8. A device for dispensing a bag from a stack of bags, the device comprising:

first and second conveyor belts mounted adjacent to one another and adapted and configured to engage between said first and second conveyor belts a bag from a stack of hanging bags;

said first conveyor belt being mounted about two rollers, axially displaced from one another, and about a third roller disposed between said two rollers and distanced from said rollers and from adjacent portions of said first and second conveyor belts, so as to cause bending of said hanging stack of bags around said third roller;

two arms merging into two pressure bars for pressing the hanging stack of bags against said first conveyor belt so as to cause said at least one conveyor belt to engage said bag of the stack of bags, and detach said engaged bag from the support;

wherein one of said pressure bars is in register with one of said two rollers, and the second of said pressure bars is in register with said third roller;

a bag retarder mounted beneath and adjacent said first and second conveyor belts, and beneath said detached bag, said bag retarder stopping downwards movement of said detached bag until the bag is engaged between said adjacent portions of said first and second conveyor belts;

means for rotating said first and second conveyor belts so as to cause them to drag said detached bag upwards between the adjacent portions to a dispensing area; and means for automatically stopping rotation of said belts after a single bag has reached said dispensing area.

9. The device according to claim 8, wherein said means for automatically stopping includes a dispensed bag detector adapted to stop rotation of said belts in response to detection of a bag in said dispensing area.

10. A method for dispensing a bag from a stack of bags, the method comprising:

pressing a stack of bags hanging from a bag support against a first conveyor belt mounted about at least two rollers;

engaging a bag from the stack of hanging bags by said first conveyor belt;

detaching said engaged bag from the stack of bags;

stopping and folding said detached bag on a bag retarder mounted beneath and adjacent said conveyor belt;

engaging and dragging said folded bag to a dispensing area between said first conveyor belt and a second conveyor belt mounted with a portion adjacent to a portion of the first conveyor belt and arranged for movement in an opposite direction thereto, said first and second conveyor belts being adapted and configured for frictionally conveying a plastic bag upwards therebetween; and automatically stopping rotation of said conveyor belts after a single bag has reached said dispensing area.

11. The method according to claim 10, further comprising partially separating a wall of the bag engaged by the conveyer belt from a second wall of the bag.

12. The method according to claim 10, further comprising:

applying asymmetric frictional force to said engaged bag to partially separate the bag from the stack and cause partial separation of the walls of the bag from one another.

13. The method according to claim 10, wherein said steps of engaging, detaching and stopping a bag include:

frictionally engaging, by said first conveyor belt, a bag from the stack of bags;

detaching the bag from the stack of bags when the frictional force applied to the bag is greater than a strength of the bag at a perforated line;

dragging said detached bag by said first conveyor belt until its bottom edge abuts a bag retarder; and folding said detached bag between the retarder and said first and second conveyor belts until its walls are frictionally engaged between said adjacent portions of said first and second belts.

14. The method according to claim 10, further comprising sensing removal of a dispensed bag from said dispensing area and rotating said first and second conveyor belts in response thereto.

15. The method according to claim 10, further comprising bending said stack of bags against a roller turning one of said conveyor belts after said step of pressing.

* * * * *